US009758286B2

(12) United States Patent
Geeraert et al.

(10) Patent No.: US 9,758,286 B2
(45) **Date of Patent: *Sep. 12, 2017**

(54) FLEXIBLE BOX BAG COMPRISING SOLUBLE UNIT DOSE DETERGENT POUCH

(71) Applicant: The Procter & Gamble Company, Cincinnati, OH (US)

(72) Inventors: Dominique Celine Ignace Marie Geeraert, Denderhoutem (BE); Mostafa Elmihy, Brussels (BE); Neil John Rogers, Vilvoorde (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/286,716

(22) Filed: Oct. 6, 2016

(65) Prior Publication Data

US 2017/0096275 A1 Apr. 6, 2017

(30) Foreign Application Priority Data

Oct. 6, 2015 (EP) ..... 15188639

(51) Int. Cl.

| | |
|---|---|
| ***B65D 77/20*** | (2006.01) |
| ***B65D 85/804*** | (2006.01) |
| ***B65D 75/56*** | (2006.01) |
| ***B65D 75/58*** | (2006.01) |
| ***C11D 17/04*** | (2006.01) |

(52) U.S. Cl.

CPC ..... *B65D 77/2024* (2013.01); *B65D 75/56* (2013.01); *B65D 75/5838* (2013.01); *B65D 85/804* (2013.01); *C11D 17/042* (2013.01); *C11D 17/046* (2013.01); *B31B 2221/00* (2013.01); *B65D 2575/586* (2013.01); *B65D 2577/205* (2013.01)

(58) Field of Classification Search

CPC ..... B65D 5/24; B65D 5/4208; B65D 5/4279; B65D 5/5405; B65D 31/10; B65D 5/4204; B65D 75/56; B65D 75/5838; B65D 77/245

USPC ..... 206/77.1; 383/103, 104, 200, 203

See application file for complete search history.

(56) References Cited

U.S. PATENT DOCUMENTS

| | | | | |
|---|---|---|---|---|
| 5,352,604 | A | 10/1994 | Wilson et al. | |
| 6,166,117 | A | 12/2000 | Miyazaki | |
| 6,659,645 | B1 * | 12/2003 | Schulz | B65D 75/5855 383/104 |
| 6,787,512 | B1 | 9/2004 | Verrall et al. | |
| 8,622,619 | B2 * | 1/2014 | Adams | B65D 75/585 383/104 |

(Continued)

FOREIGN PATENT DOCUMENTS

| | | |
|---|---|---|
| WO | WO 2005/075616 A1 | 8/2005 |
| WO | WO 2008/087497 A1 | 7/2008 |

(Continued)

OTHER PUBLICATIONS

Picture of bag of Ghirardelli chocolates, located at https://www.amazon.com/Ghirardelli-Caramel-Chocolate-Squares-Count/dp/B008DTXNAE/ref=sr_1_4_a_it?ie=UTF8&qid=1498749487&sr=8-4&keywords=ghirardelli) on Jun. 29, 2017.

*Primary Examiner* — Chun Cheung
(74) *Attorney, Agent, or Firm* — Gregory S. Darley-Emerson; Leonard W. Lewis; Steven W. Miller

(57) ABSTRACT

A detergent product including a flexible box bag and soluble unit dose detergent pouch.

14 Claims, 4 Drawing Sheets

(56) References Cited

U.S. PATENT DOCUMENTS

| | | | | |
|---|---|---|---|---|
| 9,133,329 | B2 | 9/2015 | Denome et al. | |
| 9,284,109 | B2 * | 3/2016 | James | B65D 83/00 |
| 9,404,070 | B2 | 8/2016 | Lant et al. | |
| 2002/0190112 | A1 * | 12/2002 | Culeron | B65D 77/245 229/145 |
| 2006/0124494 | A1 * | 6/2006 | Clark, Jr. | B65D 75/5833 206/440 |
| 2006/0189501 | A1 | 8/2006 | Lant et al. | |
| 2006/0213801 | A1 | 9/2006 | Karaoren et al. | |
| 2008/0081774 | A1 * | 4/2008 | Koch | C11D 3/50 510/101 |
| 2008/0193999 | A1 | 8/2008 | Andersen et al. | |
| 2009/0325846 | A1 | 12/2009 | Tantawy et al. | |
| 2010/0022431 | A1 | 1/2010 | Lant et al. | |
| 2010/0125047 | A1 | 5/2010 | Lant | |
| 2012/0070106 | A1 | 3/2012 | Camargo-Parodi et al. | |
| 2012/0070107 | A1 | 3/2012 | Camargo-Parodi et al. | |
| 2012/0258507 | A1 | 10/2012 | Adams et al. | |
| 2013/0260438 | A1 | 10/2013 | Alekseyev et al. | |
| 2014/0162929 | A1 | 6/2014 | Labeque et al. | |
| 2014/0187468 | A1 | 7/2014 | Estell et al. | |
| 2015/0132831 | A1 | 5/2015 | Olinski et al. | |
| 2015/0136636 | A1 * | 5/2015 | Sunder | C11D 17/042 206/524.6 |

FOREIGN PATENT DOCUMENTS

| | | | |
|---|---|---|---|
| WO | WO 2009/069077 | A2 | 6/2009 |
| WO | WO 2009/101593 | A2 | 8/2009 |
| WO | WO 2009/158449 | A1 | 12/2009 |
| WO | WO 2010/119022 | A1 | 10/2010 |
| WO | WO 2011/072117 | A1 | 6/2011 |
| WO | WO 2012/054835 | A1 | 4/2012 |
| WO | WO 2012/134969 | A1 | 10/2012 |
| WO | WO 2012/166768 | A1 | 12/2012 |
| WO | WO 2013/181205 | A1 | 12/2013 |

* cited by examiner

FLEXIBLE BOX BAG COMPRISING SOLUBLE UNIT DOSE DETERGENT POUCH

FIELD OF THE INVENTION

The present invention relates to a detergent product comprising a flexible box bag and a soluble unit dose detergent pouch. The flexible box bag comprises a two dimensional opening means that is capable of forming a two dimensional planar opening, which when combined with the other box bag features provide easier access to the internal volume for the consumer to remove a soluble unit dose detergent pouch from the flexible box bag during the washing process.

BACKGROUND OF THE INVENTION

Packaging for soluble unit dose detergent pouches, especially soluble unit dose laundry detergent pouches, typically comes in the form of a flexible bag or a more rigid box. Flexible bags have the advantage of being more easily handled by the consumer during the washing process, and are also more efficient in terms of transport and storage. However, the rigid box have the advantage of being easier to remove a pouch from the packaging during the washing process. In addition, rigid boxes have greater shelf impression to the consumer. Detergent manufacturers continue to seek flexible bags having the ease of handling, and transport and storage efficiency, but also having a good shelf impression of a box, and being easy to remove a pouch from during the washing process.

The Inventors provide a flexible box bag that overcomes these problems.

SUMMARY OF THE INVENTION

The present invention relates to a detergent product comprising a flexible box and a soluble unit dose detergent pouch, wherein the flexible box bag comprises six rectangular panels: top panel, bottom panel, front panel, back panel and two side panels, wherein the six rectangular panels are joined together so as to form an inner cuboidal volume inside the flexible box bag, wherein each of the top panel and bottom panel comprise a front horizontal edge, a back edge and two side edges, wherein each of the front panel, back panel and two side panels comprise a top edge, a bottom edge, and two side edges, wherein the length of the two side edges of back panel are longer than the length of the two side edges of the front panel, wherein the front edge of the top panel joins the top edge of the front panel, wherein the back edge of the top panel joins the top edge of the back panel, wherein the front edge of the bottom panel joins the bottom edge of the front panel, wherein the back edge of the bottom panel joins the bottom edge of the back panel, wherein the side edges of the top panel join the top edges of the side panels and part of the side edges of the back panel, wherein the top panel comprises a two dimensional opening means that is capable of forming a two dimensional planar opening, wherein the soluble unit dose detergent pouch is contained within the inner cuboidal volume.

BRIEF DESCRIPTION OF THE DRAWINGS

The figures herein are illustrative in nature and are not intended to be limiting.

DETAILED DESCRIPTION OF THE INVENTION

Detergent product: The detergent product comprises a flexible box bag and a soluble unit dose detergent pouch. The flexible box bag and soluble unit dose detergent pouch are described in more detail below.

Figure 1:
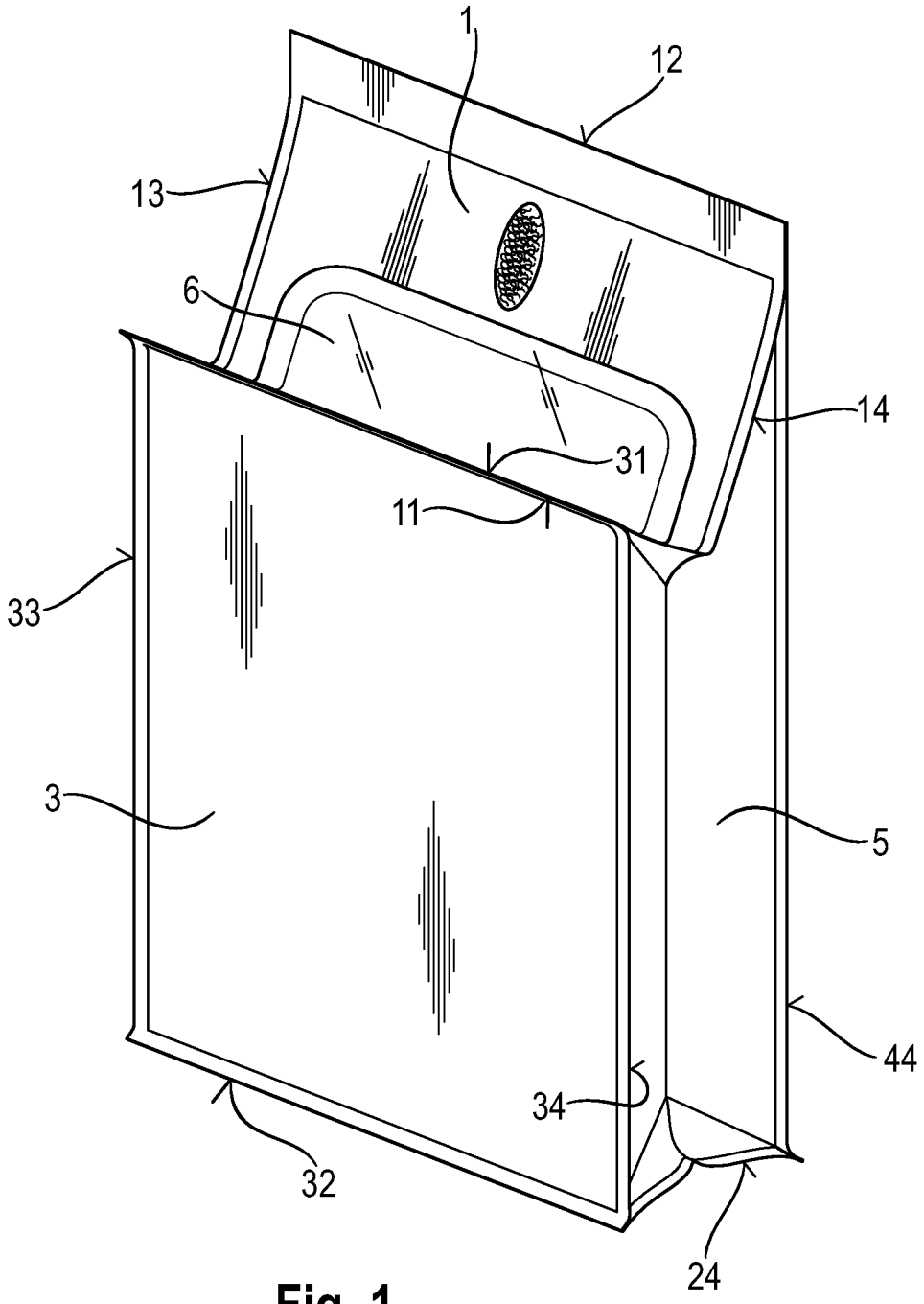
FIG. 1 shows a flexible box bag according to the present disclosure, in assembled form.
Figure 2:
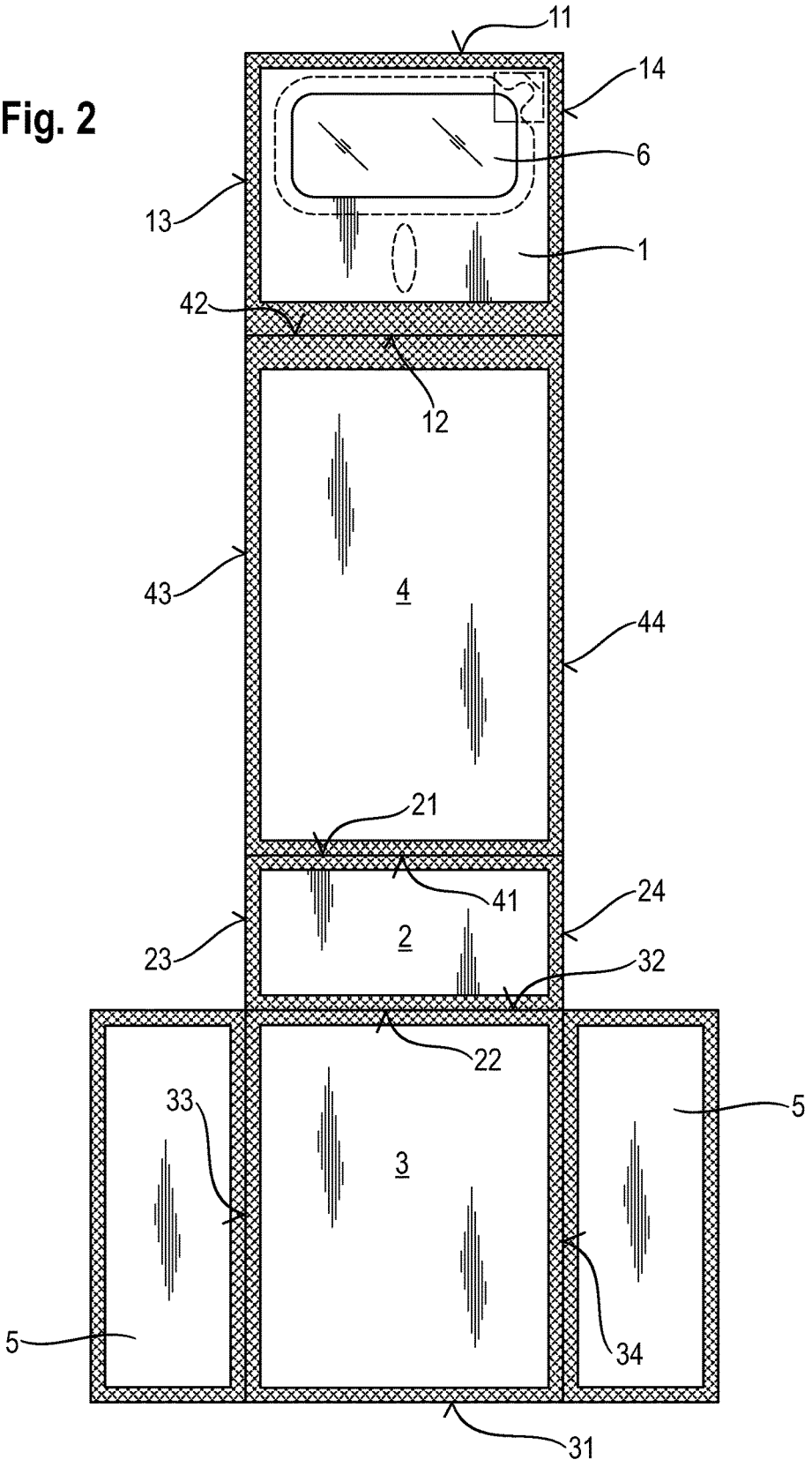
FIG. 2 shows a flexible box bag according to the present disclosure, unfolded.
Figure 3:
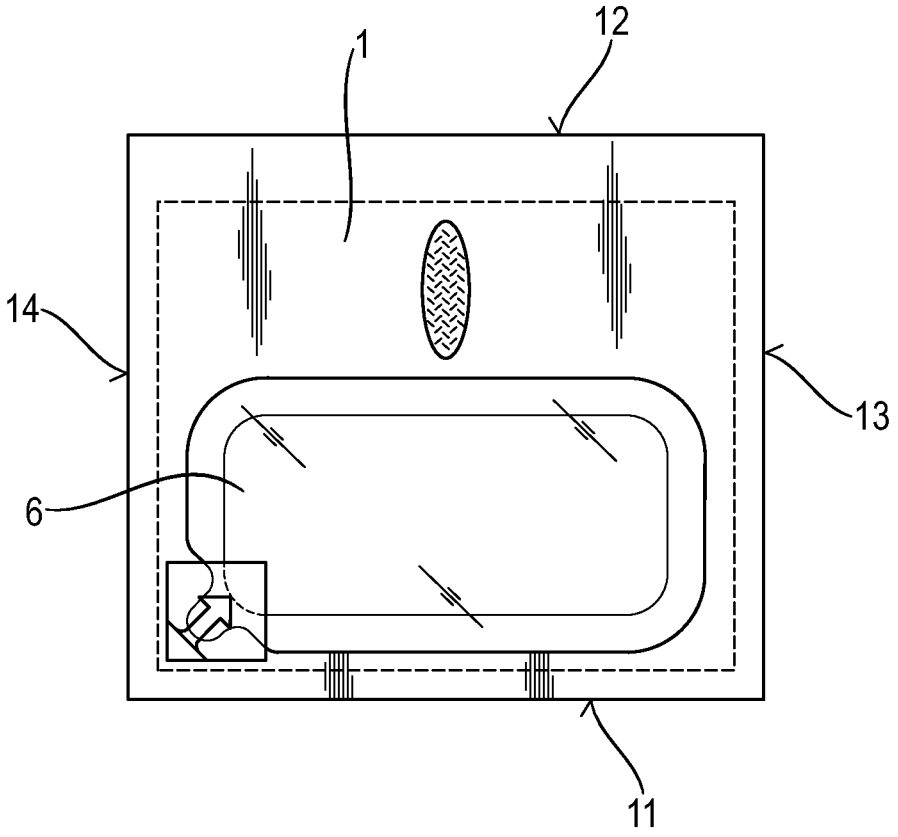
FIG. 3 shows a top panel of a flexible box bag according to the present disclosure.
Figure 4:
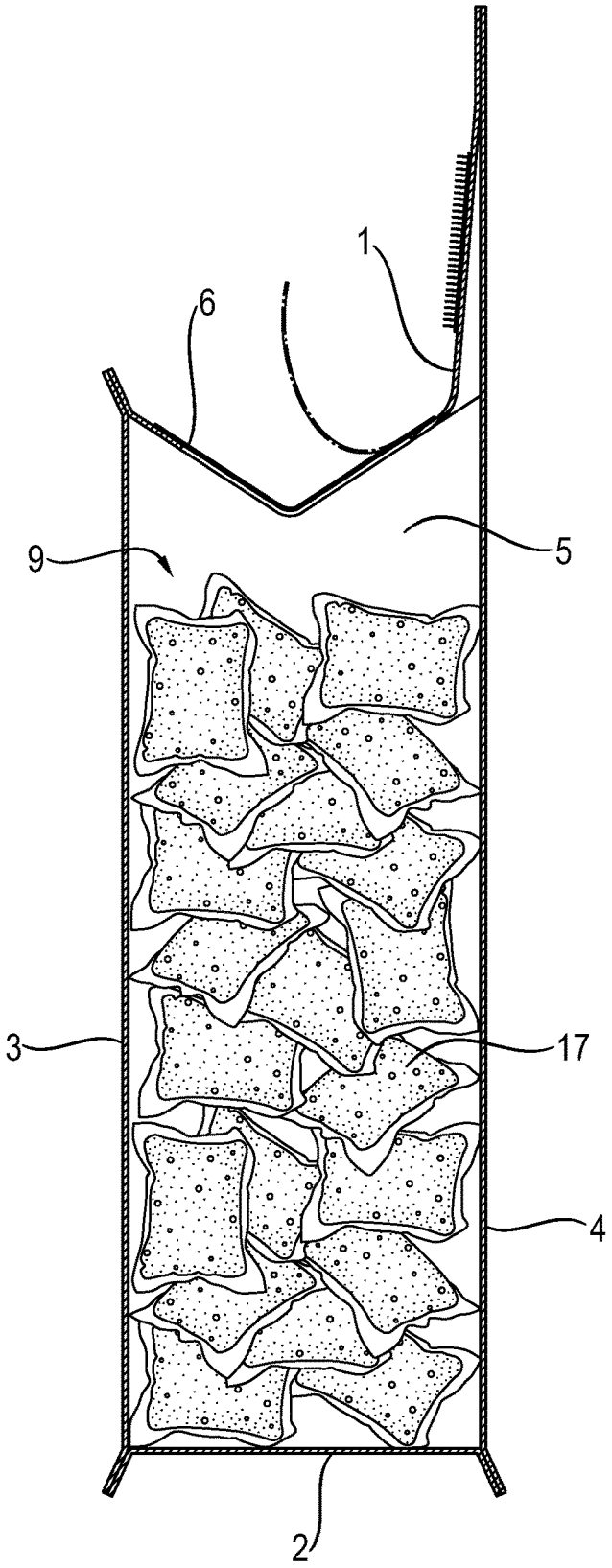
FIG. 4 shows a cross-section of a flexible box, containing a plurality of soluble unit dose pouches.

Flexible box bag: As shown in FIGS. 1-4, the flexible box bag comprises six rectangular panels: top panel 1, bottom panel 2, front panel 3, back panel 4 and two side panels 5. The six rectangular panels 1, 2, 3, 4, 5 are joined together so as to form an inner cuboidal volume 9 inside the flexible box bag. The cuboidal volume 9 is a cuboid. Suitable cuboids include square cuboids and rectangular cuboids. Preferably, the cuboidal volume 9 is a rectangular cuboidal volume. Each of the top panel 1 and bottom panel 2 comprise a front horizontal edge 11, 32, a back edge 42, 41 and two side edges 13, 14, 23, 24. Each of the front panel 3, back panel 4 and two side panels 5 comprise a top edge 12, 31, a bottom edge 21, 22, and two side edges 43, 44, 44, 34. The length of the two side edges 43, 44 of back panel 4 are longer than the length of the two side edges 33, 34 of the front panel 3. The front edge 11 of the top panel 1 joins the top edge 31 of the front panel 3. The back edge 42 of the top panel 1 joins the top edge 12 of the back panel 4. The front edge 32 of the bottom panel 2 joins the bottom edge 22 of the front panel 3. The back edge 41 of the bottom panel 2 joins the bottom edge 21 of the back panel 4. The side edges 13, 14 of the top panel 1 join the top edges of the side panels 5 and part of the side edges 43, 44 of the back panel 4. The top panel 1 comprises a two dimensional opening means 6 that is capable of forming a two dimensional planar opening. The pouches 17 are contained within the inner cuboidal volume 9.

Typically, the six rectangular panels are made of weldable sheet material and are secured together at the edges by weld seams. The weldable sheet material is described in more detail below.

Typically, at least one of the panels, preferably at least one of the side panels 5, comprise a handle. The handle is described in more detail below.

It may be preferred for at least one of the panels, preferable one or more of the side panels 5, to be transparent. In this manner, typically, the pouches 17 are visible from the outside of the detergent product.

It may be preferred that the top edge of the back panel 4 is capable of being folded over the front edge of the top panel and being fastened to the front panel. Suitable fastening means includes a clip, button, ties, adhesive labels, slider/zipper, hook and loop fasteners or hook and hook fasteners.

The flexible box bag is typically a stand-up bag.

The panels may be composed of film material, suitable film material includes polyethylene (PE), polyethylene terephalate (PET), amorphous polyethylene terephalate (APET), recycled amorphous polyethylene terephathalate (RPET), foamed polyethylene terephthalate (XPET), polyethylene terephthalate glycol (GPET), polypropylene (PP), high impact polystyrene (HIPS), nylon (PA), polylactic acid (PLA), thermoplastic starch (TPS), ethylvinylacetate (EVA)

and any combination thereof. A preferred film material is a PET/PE laminate, and/or a PE/PE laminate. A suitable laminate comprises an outer layer of PET having a width of from 10 to 15 micrometers, and an inner layer of PE having a width of from 50 to 200 micrometers.

The panels may also comprise a metallic gloss, and/or comprise print, for example revere flexo printing.

Opening means: Typically, the opening means 6 comprises a laser-scored line in a two dimensional pattern. The two dimensional pattern is typically L shaped, or curved, however other two dimensional patterns are also suitable. Ensuring that the opening means 6 is two dimensional and is capable of forming a two dimensional planar opening improves the accessibility to the inner cuboidal volume 9. This in turn improves the consumer experience when removing a pouch 17 from the flexible box bag.

The opening means 6 may comprise a reclosing means. A suitable reclosing means may comprise an adhesive closing panel that is capable of enclosing the opening. Suitable reclosing means include a cap, zip, velcro fastener, slide fastener or a hook and loop fastener.

Weldable sheet material: Typically, the weldable sheet material is a multilayer co-extruded film or a composite film that has a heat-weldable polymer layer on the inside of the flexible box bag.

Handle: Typically, the handle is a film strip, or a textile strip, typically the handle is reinforced, for example by a film strip, or integrated into the front and back panels. The handle further improves the ease of handling and manipulation of the flexible box bag.

Soluble unit dose detergent pouch: The soluble unit dose detergent pouch 17 is contained within the inner cuboidal volume 9. The soluble unit dose detergent pouch typically comprises surfactant. The soluble unit dose detergent pouch can be a soluble unit dose laundry detergent pouch or a soluble unit dose dish-washing detergent pouch. Most preferably, the soluble unit dose detergent pouch is a soluble unit dose laundry detergent pouch. A suitable soluble unit dose laundry detergent pouch is described in more detail below. The soluble unit dose detergent pouch is soluble in water. Preferably, the soluble unit dose detergent pouch is a multi-compartment laundry detergent water-soluble pouch. A suitable multi-compartment laundry detergent water-soluble pouch is described in more detail below.

Multi-compartment laundry detergent water-soluble pouch: The multi-compartment laundry detergent water-soluble pouch comprises a first compartment and a second compartment.

The detergent pouch typically has a height, a width and a length. The maximum of any of these dimensions is meant to mean the greatest distance between two points on opposite sides of the detergent pouch. In other words, the detergent pouch may not have straight sides and so may have variable lengths, widths and heights depending on where the measurement is taken. Therefore, the maximum should be measured at any two points that are the furthest apart from each other. The maximum length is typically between 2 cm and 5 cm, or even between 2 cm and 4 cm, or even between 2 cm and 3 cm. The maximum length may be greater than 2 cm and less than 6 cm. The maximum width is typically between 2 cm and 5 cm. The maximum width may be greater than 3 cm and less than 6 cm. The maximum height is typically between 2 cm and 5 cm. The maximum height may be greater than 2 cm and less than 4 cm. Preferably, the length: height ratio is from 3:1 to 1:1; or the width: height ratio is from 3:1 to 1:1, or even 2.5:1 to 1:1; or the ratio of length to height is from 3:1 to 1:1 and the ratio of width to height is from 3:1 to 1:1, or even 2.5:1 to 1:1, or a combination thereof. Without wishing to be bound by theory, the Inventors found that by carefully regulating the length, width and height of the detergent pouch, they were less likely to become trapped between the door and the seal, or within the seal itself of an automatic laundry washing machine.

Typically, the detergent pouch comprises a liquid laundry detergent composition. The volume of the liquid laundry detergent composition within the detergent pouch may be between 10 and 27 ml, preferably between 10 and 23 ml, preferably between 10 and 20 ml. Without wishing to be bound by theory, it was found that by carefully regulating the volume, the detergent pouch was less likely to become trapped between the door and the seal, or within the seal itself of an automatic laundry washing machine.

The detergent pouch may have a weight of less than 30 g, or even between 10 g and 28 g, or even between 10 g and 25 g. Without wishing to be bound by theory, it was found that by carefully regulating the weight, the detergent pouch was less likely to become trapped between the door and the seal, or within the seal itself of an automatic laundry washing machine.

The detergent pouch may comprise a gas, and wherein the ratio of the volume of said gas to the volume of the liquid laundry detergent composition is between 1:4 and 1:20, or even between 1:5 and 1:15, or even between 1:5 and 1:9. Without wishing to be bound by theory, it was found that by carefully regulating the volume of gas to volume of liquid the dissolution of the film and dispersion of the liquid laundry detergent composition in the wash liquor could be maximised. There is a tendency of highly concentrated surfactant compositions that may be present in the detergent pouch to gel upon contact with water. This gelling effect causes a competition between the internal laundry detergent composition and the film for the available water in the wash liquor. The competition can result in reduced dissolution of the film of the detergent pouch. By providing an air interface rather than a detergent interface for the film results in less competition for the available water and increases the dissolution rate of the film.

Typically, the detergent pouch comprises multiple compartments. The detergent pouch comprises two, and may comprise three, or four or five compartments.

Typically, a water-soluble film is shaped such that it defines the shape of the compartment, such that the compartment is completely surrounded by the film. The compartment may be formed from a single film, or multiple films. For example the compartment may be formed from two films which are sealed together (e.g. heat sealed, solvent sealed or a combination thereof). Typically, the water-soluble film is sealed such that the composition does not leak out of the compartment during storage. However, upon addition of the water-soluble pouch to water, the water-soluble film dissolves and releases the contents of the internal compartment into the wash liquor.

The detergent pouch can be of any form, shape and material which is suitable for holding the composition, i.e. without allowing the release of the composition, and any additional component, from the detergent pouch prior to contact of the detergent pouch with water. The exact execution will depend, for example, on the type and amount of the compositions in the detergent pouch. The detergent pouch may have a substantially, square, rectangular, oval, elliptoid, superelliptical, or circular shape. The shape may or may not include any excess material present as a flange or skirt at the point where two or more films are sealed together. By substantially, we herein mean that the shape has an overall impression of being for example square. It may have rounded corners and/or non-straight sides, but overall it gives the impression of being square for example. The maximum length or maximum width or maximum height may include the flange. Alternatively the maximum length, the maximum width, or the maximum height may not include the flange material and may include the compartments only.

A multi-compartment detergent pouch form may be desirable for such reasons as: separating chemically incompatible ingredients; or where it is desirable for a portion of the ingredients to be released into the wash earlier or later.

The multiple compartments may be arranged in any suitable orientation. For example the detergent pouch may comprise a bottom compartment, and at least a first top compartment, wherein the top compartment is superposed onto the bottom compartment. The detergent pouch may comprise a bottom compartment and at least a first and a second top compartment, wherein the top compartments are arranged side-by-side and are superposed on the bottom compartment; preferably, wherein the article comprises a bottom compartment and at least a first, a second and a third top compartment, wherein the top compartments are arranged side-by-side and are superposed on the bottom compartment. The detergent pouch may comprise a bottom compartment and at least a first and a second top compartment, wherein the top compartments are arranged side-by-side and are superposed on the bottom compartment. The pouch may comprise a bottom compartment and at least a first, a second and a third top compartment, wherein the top compartments are arranged side-by-side and are superposed on the bottom compartment, and wherein the maximum length is between 2 cm and 5 cm, or even between 2 cm and 4 cm, or even between 2 cm and 3 cm, the maximum width is between 2 cm and 5 cm and the maximum height is between 2 cm and 5 cm.

The ratio of the surface area to volume ratio of the combined top compartments to the surface area to volume ratio of bottom compartment may be between 1:1.25 and 1:2.25, or even between 1:1.5 and 1:2. In this context the surface area is that which is in contact with the external environment only, and not that which is in contact with a neighbouring compartment. Without wishing to be bound by theory, it was found that the specific ratios of surface area to volume ratio of the top compartments to the bottom compartment helped reduce the instances of the detergent pouch becoming trapped.

Alternatively, the compartments may all be positioned in a side-by-side arrangement. In such an arrangement the compartments may be connected to one another and share a dividing wall, or may be substantially separated and simple held together by a connector or bridge. Alternatively, the compartments may be arranged in a 'tyre and rim' orientation, i.e. a first compartment is positioned next to a second compartment, but the first compartment at least partially surrounds the second compartment, but does not completely enclose the second compartment.

It may be preferred that the first compartment and second compartment are in side by side configuration such that the compartments are physically joined through together through a seal. Such a configuration helps minimize any migration of ingredients from one compartment to the other during storage, which in turn can lead to an improvement in the storage stability profile of the pouch.

Preferably, the detergent pouch ruptures between 10 seconds and 5 minutes once the detergent pouch has been added to 950 ml of deionised water at 20-21° C. in a 1 L beaker, wherein the water is stirred at 350 rpm with a 5 cm magnetic stirrer bar. By rupture, we herein mean the film is seen to visibly break or split. Shortly after the film breaks or splits the internal liquid detergent composition may be seen to exit the detergent pouch into the surrounding water.

Water-soluble film: The film of the detergent pouch is soluble or dispersible in water, and preferably has a water-solubility of at least 50%, preferably at least 75% or even at least 95%, as measured by the method set out here after using a glass-filter with a maximum pore size of 20 microns:

50 grams±0.1 gram of film material is added in a pre-weighed beaker and 1000 m±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the film material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Preferred film materials are polymeric materials. The film material can be obtained, for example, by casting, blow-moulding, extrusion or blown extrusion of the polymeric material, as known in the art. Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000. Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material. Preferred films exhibit good dissolution in cold water, meaning unheated water straight from the tap. Preferably such films exhibit good dissolution at temperatures below 25° C., more preferably below 21° C., more preferably below 15° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310, M9467, films described in U.S. Pat. No. 6,166,117 and U.S. Pat. No. 6,787,512 and PVA films of corresponding solubility and deformability characteristics. Further preferred films are those describes in US2006/0213801, WO 2010/119022, US2011/0188784 and U.S. Pat. No. 6,787,512.

Preferred water soluble films are those resins comprising one or more PVA polymers, preferably said water soluble film resin comprises a blend of PVA polymers. For example, the PVA resin can include at least two PVA polymers, wherein as used herein the first PVA polymer has a viscosity less than the second PVA polymer, A first PVA polymer can have a viscosity of at least 8 cP (cP mean centipoise), 10 cP, 12 cP, or 13 cP and at most 40 cP, 20 cP, 15 cP, or 13 cP, for example in a range of about 8 cP to about 40 cP, or 10 cP to about 20 cP, or about 10 cP to about 15 cP, or about 12 cP to about 14 cP, or 13 cP. Furthermore, a second PVA polymer can have a viscosity of at least about 10 cP, 20 cP, or 22 cP and at most about 40 cP, 30 cP, 25 cP, or 24 cP, for example in a range of about 10 cP to about 40 cP, or 20 to about 30 cP, or about 20 to about 25 cP, or about 22 to about 24, or about 23 cP. The viscosity of a PVA polymer is determined by measuring a freshly made solution using a Brookfield LV type viscometer with UL adapter as described in British Standard EN ISO 15023-2:2006 Annex E Brookfield Test method. It is international practice to state the viscosity of 4% aqueous polyvinyl alcohol solutions at 20 .deg.C. All viscosities specified herein in cP should be understood to refer to the viscosity of 4% aqueous polyvinyl alcohol solution at 20 .deg.C, unless specified otherwise. Similarly, when a resin is described as having (or not having) a particular viscosity, unless specified otherwise, it is intended that the specified viscosity is the average viscosity for the resin, which inherently has a corresponding molecular weight distribution.

The individual PVA polymers can have any suitable degree of hydrolysis, as long as the degree of hydrolysis of the PVA resin is within the ranges described herein. Optionally, the PVA resin can, in addition or in the alternative, include a first PVA polymer that has a Mw in a range of about 50,000 to about 300,000 Daltons, or about 60,000 to about 150,000 Daltons; and a second PVA polymer that has a Mw in a range of about 60,000 to about 300,000 Daltons, or about 80,000 to about 250,000 Daltons.

The PVA resin can still further include one or more additional PVA polymers that have a viscosity in a range of about 10 to about 40 cP and a degree of hydrolysis in a range of about 84% to about 92%.

When the PVA resin includes a first PVA polymer having an average viscosity less than about 11 cP and a polydispersity index in a range of about 1.8 to about 2.3, then in one type of embodiment the PVA resin contains less than about 30 wt. % of the first PVA polymer. Similarly, when the PVA resin includes a first PVA polymer having an average viscosity less than about 11 cP and a polydispersity index in a range of about 1.8 to about 2.3, then in another, non-exclusive type of embodiment the PVA resin contains less than about 30 wt. % of a PVA polymer having a Mw less than about 70,000 Daltons.

Of the total PVA resin content in the film described herein, the PVA resin can comprise about 30 to about 85 wt. % of the first PVA polymer, or about 45 to about 55 wt. % of the first PVA polymer. For example, the PVA resin can contain about 50 wt. % of each PVA polymer, wherein the viscosity of the first PVA polymer is about 13 cP and the viscosity of the second PVA polymer is about 23 cP.

One type of embodiment is characterized by the PVA resin including about 40 to about 85 wt. % of a first PVA polymer that has a viscosity in a range of about 10 to about 15 cP and a degree of hydrolysis in a range of about 84% to about 92%. Another type of embodiment is characterized by the PVA resin including about 45 to about 55 wt. % of the first PVA polymer that has a viscosity in a range of about 10 to about 15 cP and a degree of hydrolysis in a range of about 84% to about 92%. The PVA resin can include about 15 to about 60 wt. % of the second PVA polymer that has a viscosity in a range of about 20 to about 25 cP and a degree of hydrolysis in a range of about 84% to about 92%. One contemplated class of embodiments is characterized by the PVA resin including about 45 to about 55 wt. % of the second PVA polymer. When the PVA resin includes a plurality of PVA polymers the PDI value of the PVA resin is greater than the PDI value of any individual, included PVA polymer. Optionally, the PDI value of the PVA resin is greater than 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.5, or 5.0.

Preferably the PVA resin has a weighted, average degree of hydrolysis ($\overline{H^{\circ}}$) between about 80 and about 92%, or between about 83 and about 90%, or about 85 and 89%. For example, $\overline{H^{\circ}}$ for a PVA resin that comprises two or more PVA polymers is calculated by the formula $\overline{H^{\circ}}=\Sigma(Wi.H_i)$ where $W_i$ is the weight percentage of the respective PVA polymer and a $H_i$ is the respective degrees of hydrolysis. Still further it is desirable to choose a PVA resin that has a weighted log viscosity ($\overline{\mu}$) between about 10 and about 25, or between about 12 and 22, or between about 13.5 and about 20. The $\overline{\mu}$ for a PVA resin that comprises two or more PVA polymers is calculated by the formula $\overline{\mu}=e^{\Sigma W_i.ln\mu_i}$ where $\mu_t$ is the viscosity for the respective PVA polymers.

Yet further, it is desirable to choose a PVA resin that has a Resin Selection Index (RSI) in a range of 0.255 to 0.315, or 0.260 to 0.310, or 0.265 to 0.305, or 0.270 to 0.300, or 0.275 to 0.295, preferably 0.270 to 0.300. The RSI is calculated by the formula; $\Sigma(W_i|\mu_i-\mu_t|)/\Sigma(W_i\mu_i)$, wherein $\mu_t$ is seventeen, $\mu_i$ is the average viscosity each of the respective PVOH polymers, and $W_i$ is the weight percentage of the respective PVOH polymers.

Naturally, different film material and/or films of different thickness may be employed in making the compartments of the present invention. A benefit in selecting different films is that the resulting compartments may exhibit different solubility or release characteristics.

The film material herein can also comprise one or more additive ingredients. For example, it can be beneficial to add plasticisers, for example glycerol, ethylene glycol, diethyleneglycol, propylene glycol, sorbitol and mixtures thereof. Other additives may include water and functional detergent additives, including water, to be delivered to the wash water, for example organic polymeric dispersants, etc.

The film may be lactone free. By this we mean that the film does not comprise any lactone. Alternatively, the film may comprise very low levels of lactone that are present due to impurities but which have not been deliberately added. However, essentially the film will be free of lactone.

The film may comprise an area of print. The area of print may cover the entire film or part thereof. The area of print may comprise a single colour or may be comprise multiple colours, even three colours. The area of print may comprise pigments, dyes, blueing agents or mixtures thereof. The print may be present as a layer on the surface of the film or may at least partially penetrate into the film. The detergent pouch may comprise at least two films, or even at least three films, wherein the films are sealed together. The area of print may be present on one film, or on more than film, e.g. on two films, or even on three films.

The area of print may be achieved using standard techniques, such as flexographic printing or inkjet printing. Preferably, the area of print is achieved via flexographic printing, in which a film is printed, then moulded into the shape of an open compartment. This compartment is then filled with a detergent composition and a second film placed over the compartment and sealed to the first film. The area of print may be on either side of the film.

The area of print may be purely aesthetic or may provide useful information to the consumer.

The area of print may be opaque, translucent or transparent.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

It may be preferred for the water-soluble pouch to comprise a film of polyvinyl alcohol.

Liquid laundry detergent composition: The detergent pouch may comprise a liquid laundry detergent composition. The liquid composition may be opaque, transparent or translucent. Each compartment may comprise the same or a different composition. The detergent pouch may comprise a liquid composition, however, it may also comprise different compositions in different compartments. The composition may be any suitable composition. The composition may be in the form of a solid, a liquid, a dispersion, a gel, a paste, a fluid or a mixture thereof. The composition may be in different forms in the different compartments. The laundry detergent composition may be used during the main wash process or could be used as pre-treatment or soaking compositions.

Laundry detergent compositions include fabric detergents, fabric softeners, 2-in-1 detergent and softening, pretreatment compositions and the like. Laundry detergent compositions may comprise surfactants, builders, chelating agents, dye transfer inhibiting agents, dispersants, enzymes, and enzyme stabilizers, catalytic materials, bleach activators, polymeric dispersing agents, clay soil removal/anti-redeposition agents, brighteners, suds suppressors, dyes, additional perfume and perfume delivery systems, structure elasticizing agents, fabric softeners, carriers, hydrotropes, processing aids and/or pigments and mixtures thereof. The composition may be a laundry detergent composition comprising an ingredient selected from the group comprising a shading dye, surfactant, polymers, perfumes, encapsulated perfume materials, structurant and mixtures thereof.

The liquid laundry detergent composition may comprise an ingredient selected from, bleach, bleach catalyst, dye, hueing dye, cleaning polymers including alkoxylated polyamines and polyethyleneimines, soil release polymer, surfactant, solvent, dye transfer inhibitors, chelant, enzyme, perfume, encapsulated perfume, polycarboxylates, structurant and mixtures thereof.

Surfactants can be selected from anionic, cationic, zwitterionic, non-ionic, amphoteric or mixtures thereof. Preferably, the fabric care composition comprises anionic, non-ionic or mixtures thereof.

The anionic surfactant may be selected from linear alkyl benzene sulfonate, alkyl ethoxylate sulphate and combinations thereof.

Suitable anionic surfactants useful herein can comprise any of the conventional anionic surfactant types typically used in liquid detergent products. These include the alkyl benzene sulfonic acids and their salts as well as alkoxylated or non-alkoxylated alkyl sulfate materials.

Suitable nonionic surfactants for use herein include the alcohol alkoxylate nonionic surfactants. Alcohol alkoxylates are materials which correspond to the general formula:

$R^1(C_mH_{2m}O)_nOH$ wherein $R^1$ is a $C_8$-$C_{16}$ alkyl group, m is from 2 to 4, and n ranges from about 2 to 12. In one aspect, $R^1$ is an alkyl group, which may be primary or secondary, that comprises from about 9 to 15 carbon atoms, or from about 10 to 14 carbon atoms. In one aspect, the alkoxylated fatty alcohols will also be ethoxylated materials that contain on average from about 2 to 12 ethylene oxide moieties per molecule, or from about 3 to 10 ethylene oxide moieties per molecule.

The shading dyes employed in the present laundry detergent compositions may comprise polymeric or non-polymeric dyes, pigments, or mixtures thereof. Preferably the shading dye comprises a polymeric dye, comprising a chromophore constituent and a polymeric constituent. The chromophore constituent is characterized in that it absorbs light in the wavelength range of blue, red, violet, purple, or combinations thereof upon exposure to light. In one aspect, the chromophore constituent exhibits an absorbance spectrum maximum from about 520 nanometers to about 640 nanometers in water and/or methanol, and in another aspect, from about 560 nanometers to about 610 nanometers in water and/or methanol.

Although any suitable chromophore may be used, the dye chromophore is preferably selected from benzodifuranes, methine, triphenylmethanes, napthalimides, pyrazole, napthoquinone, anthraquinone, azo, oxazine, azine, xanthene, triphenodioxazine and phthalocyanine dye chromophores. Mono and di-azo dye chromophores are preferred.

The shading dye may comprise a dye polymer comprising a chromophore covalently bound to one or more of at least three consecutive repeat units. It should be understood that the repeat units themselves do not need to comprise a chromophore. The dye polymer may comprise at least 5, or at least 10, or even at least 20 consecutive repeat units.

The repeat unit can be derived from an organic ester such as phenyl dicarboxylate in combination with an oxyalkyleneoxy and a polyoxyalkyleneoxy. Repeat units can be derived from alkenes, epoxides, aziridine, carbohydrate including the units that comprise modified celluloses such as hydroxyalkylcellulose; hydroxypropyl cellulose; hydroxypropyl methylcellulose; hydroxybutyl cellulose; and, hydroxybutyl methylcellulose or mixtures thereof. The repeat units may be derived from alkenes, or epoxides or mixtures thereof. The repeat units may be $C_2$-$C_4$ alkyleneoxy groups, sometimes called alkoxy groups, preferably derived from $C_2$-$C_4$ alkylene oxide. The repeat units may be $C_2$-$C_4$ alkoxy groups, preferably ethoxy groups.

For the purposes of the present invention, the at least three consecutive repeat units form a polymeric constituent. The polymeric constituent may be covalently bound to the chromophore group, directly or indirectly via a linking group. Examples of suitable polymeric constituents include polyoxyalkylene chains having multiple repeating units. In one aspect, the polymeric constituents include polyoxyalkylene chains having from 2 to about 30 repeating units, from 2 to about 20 repeating units, from 2 to about 10 repeating units or even from about 3 or 4 to about 6 repeating units. Non-limiting examples of polyoxyalkylene chains include ethylene oxide, propylene oxide, glycidol oxide, butylene oxide and mixtures thereof.

The dye may be introduced into the detergent composition in the form of the unpurified mixture that is the direct result of an organic synthesis route. In addition to the dye polymer therefore, there may also be present minor amounts of un-reacted starting materials, products of side reactions and mixtures of the dye polymers comprising different chain lengths of the repeating units, as would be expected to result from any polymerisation step.

The compositions can comprise one or more detergent enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is a cocktail of conventional applicable enzymes like protease, lipase, cutinase and/or cellulase in conjunction with amylase.

The laundry detergent compositions of the present invention may comprise one or more bleaching agents. Suitable bleaching agents other than bleaching catalysts include photobleaches, bleach activators, hydrogen peroxide, sources of hydrogen peroxide, pre-formed peracids and mixtures thereof. In general, when a bleaching agent is used, the compositions of the present invention may comprise from about 0.1% to about 50% or even from about 0.1% to about 25% bleaching agent by weight of the subject cleaning composition.

The composition may comprise a brightener. Suitable brighteners are stilbenes, such as brightener 15. Other suitable brighteners are hydrophobic brighteners, and brightener 49. The brightener may be in micronized particulate form, having a weight average particle size in the range of from 3 to 30 micrometers, or from 3 micrometers to 20 micrometers, or from 3 to 10 micrometers. The brightener can be alpha or beta crystalline form.

The compositions herein may also optionally contain one or more copper, iron and/or manganese chelating agents. If utilized, chelating agents will generally comprise from about 0.1% by weight of the compositions herein to about 15%, or even from about 3.0% to about 15% by weight of the compositions herein.

The composition may comprise a calcium carbonate crystal growth inhibitor, such as one selected from the group consisting of: 1-hydroxyethanediphosphonic acid (HEDP) and salts thereof; N,N-dicarboxymethyl-2-aminopentane-1,5-dioic acid and salts thereof; 2-phosphonobutane-1,2,4-tricarboxylic acid and salts thereof; and any combination thereof.

The compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in the compositions herein, the dye transfer inhibiting agents are present at levels from about 0.0001%, from about 0.01%, from about 0.05% by weight of the cleaning compositions to about 10%, about 2%, or even about 1% by weight of the cleaning compositions.

The laundry detergent composition may comprise one or more polymers. Suitable polymers include carboxylate polymers, polyethylene glycol polymers, polyester soil release polymers such as terephthalate polymers, amine polymers, cellulosic polymers, dye transfer inhibition polymers, dye lock polymers such as a condensation oligomer produced by condensation of imidazole and epichlorhydrin, optionally in ratio of 1:4:1, hexamethylenediamine derivative polymers, and any combination thereof.

Other suitable cellulosic polymers may have a degree of substitution (DS) of from 0.01 to 0.99 and a degree of blockiness (DB) such that either DS+DB is of at least 1.00 or $DB+2DS-DS^2$ is at least 1.20. The substituted cellulosic polymer can have a degree of substitution (DS) of at least 0.55. The substituted cellulosic polymer can have a degree of blockiness (DB) of at least 0.35. The substituted cellulosic polymer can have a DS+DB, of from 1.05 to 2.00. A suitable substituted cellulosic polymer is carboxymethylcellulose.

Another suitable cellulosic polymer is cationically modified hydroxyethyl cellulose.

Suitable perfumes include perfume microcapsules, polymer assisted perfume delivery systems including Schiff base perfume/polymer complexes, starch-encapsulated perfume accords, perfume-loaded zeolites, blooming perfume accords, and any combination thereof. A suitable perfume microcapsule is melamine formaldehyde based, typically comprising perfume that is encapsulated by a shell comprising melamine formaldehyde. It may be highly suitable for such perfume microcapsules to comprise cationic and/or cationic precursor material in the shell, such as polyvinyl formamide (PVF) and/or cationically modified hydroxyethyl cellulose (catHEC).

Suitable suds suppressors include silicone and/or fatty acid such as stearic acid.

The liquid laundry detergent composition may be coloured. The colour of the liquid laundry detergent composition may be the same or different to any printed area on the film of the article. Each compartment of the detergent pouch may have a different colour. Preferably, the liquid laundry detergent composition comprises a non-substantive dye having an average degree of alkoxylation of at least 16.

At least one compartment of the detergent pouch may comprise a solid. If present, the solid may be present at a concentration of at least 5% by weight of the detergent pouch.

Method of making the detergent product: The method of making the detergent product comprises the steps: forming an interim flexible box bag by suitably joining together the edges of the six panels except for the back edge of the top panel and top edge of the back panel. The soluble unit dose detergent pouch is inserted into the inner cuboidal volume by passing through a filling opening that is formed between the back edge of the top panel and top edge of the back panel. The back edge of the top panel and top edge of the back panel are joined together in such a manner as to close the filling opening to form the flexible box bag and detergent product. Typically, after it is filled, the interim flexible box bag is sealed by a weld seal.

The flexible box bag may be made from at least two different webs of film. For example, a first film may form the top panel, bottom panel, back panel, and front panel, and a second film may form the side panels. In this manner, the flexible box bag may have transparent side panels The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent product comprising a flexible box bag and soluble unit dose detergent pouch, wherein the flexible box bag comprises six rectangular panels: top panel, bottom panel, front panel, back panel and two side panels, wherein the six rectangular panels are joined together so as to form an inner cuboidal volume inside the flexible box bag, wherein each of the top panel and bottom panel comprise a front horizontal edge, a back edge and two side edges, wherein each of the front panel, back panel and two side panels comprise a top edge, a bottom edge, and two side edges, wherein the length of the two side edges of back panel are longer than the length of the two side edges of the front panel, wherein the front edge of the top panel joins the top edge of the front panel, wherein the back edge of the top panel joins the top edge of the back panel, wherein the front edge of the bottom panel joins the bottom edge of the front panel, wherein the back edge of the bottom panel joins the bottom edge of the back panel, wherein the side edges of the top panel join the top edges of the side panels and part of the side edges of the back panel, wherein the top panel comprises a two dimensional planar opening and a two dimensional opening means, wherein the two dimensional planar opening provides access to the inner cuboidal volume when the two dimensional opening means is operated, wherein the soluble unit dose detergent pouch is contained within the inner cuboidal volume.

2. A detergent product according to claim 1, wherein the six rectangular panels are made of weldable sheet material and are secured together at the edges by weld seams.

3. A detergent product according to claim 1, wherein at least one of the panels comprise a handle.

4. A detergent product according to claim 3, wherein at least one of the side panels comprise a handle.

5. A detergent product according to claim 1, wherein the opening means comprises laser-scored line in a two dimensional pattern.

6. A detergent product according to claim 1, wherein the opening means comprises a reclosing means.

7. A detergent product according to claim 6, wherein the reclosing means comprises an adhesive closing panel that is capable of enclosing the opening.

8. A detergent product according to claim 1, wherein the top edge of the back panel is capable of being folded over the front edge of the top panel and being fastened to the front panel.

9. A detergent product according to claim 1, wherein at least one of the panels is transparent.

10. A detergent product according to claim 1, wherein the soluble unit dose detergent pouch is a soluble unit dose laundry detergent pouch.

11. A detergent product according to claim 1, wherein the two dimensional planar opening is located away from each of the front horizontal edge, the back edge, and the two side edges of the top panel.

12. A detergent product according to claim 1, wherein the two dimensional opening means overlays a top surface of the top panel, wherein the top surface faces away from the inner cuboidal volume.

13. A detergent product according to claim 1, wherein the top panel comprises two oblique planar surfaces, and wherein the opening means is formed on the two oblique planar surfaces.

14. A method of making a detergent product according to claim 1, wherein an interim flexible box bag is formed by suitably joining together the edges of the six panels except for the back edge of the top panel and top edge of the back panel, wherein the soluble unit dose detergent pouch is inserted into the inner cuboidal volume by passing through a filling opening that is formed between the back edge of the top panel and top edge of the back panel, wherein the back edge of the top panel and top edge of the back panel are joined together in such a manner as to close the filling opening to form the flexible box bag and detergent product.

* * * * *